US007295897B2

(12) United States Patent
Marando et al.

(10) Patent No.: US 7,295,897 B2
(45) Date of Patent: Nov. 13, 2007

(54) MAPPING A PLURALITY OF SENSORS TO RESPECTIVE ZONES IN A FAN CONTROL SYSTEM

(75) Inventors: Eileen M. Marando, Bellmore, NY (US); Robert W. Schoepflin, Port Jefferson, NY (US)

(73) Assignee: Standard Microsystems Corporation, Hauppauge, NY (US)

( * ) Notice: Subject to any disclaimer, the term of this patent is extended or adjusted under 35 U.S.C. 154(b) by 688 days.

(21) Appl. No.: 10/784,837

(22) Filed: Feb. 23, 2004

(65) Prior Publication Data

US 2005/0186083 A1 Aug. 25, 2005

(51) Int. Cl.

| | |
|---|---|
| ***G01M 1/38*** | (2006.01) |
| ***G05B 13/00*** | (2006.01) |
| ***H02H 7/08*** | (2006.01) |
| ***F24D 5/14*** | (2006.01) |

(52) U.S. Cl. ..... 700/278; 700/277; 700/299; 318/472; 318/471; 236/1 B

(58) Field of Classification Search ..... 700/277, 700/278, 299, 300; 318/471, 472, 473; 236/1 B, 236/DIG. 9; 417/32, 42

See application file for complete search history.

(56) References Cited

U.S. PATENT DOCUMENTS

| | | | |
|---|---|---|---|
| 4,722,669 | A | 2/1988 | Kundert |
| 4,727,468 | A | 2/1988 | Maekawa |
| 5,249,741 | A | 10/1993 | Bistline et al. |
| 5,307,439 | A | 4/1994 | Enami |
| 5,687,079 | A | 11/1997 | Bauer et al. |
| 5,727,928 | A | 3/1998 | Brown |
| 5,825,972 | A | 10/1998 | Brown |
| 5,942,866 | A | 8/1999 | Hsieh |
| 5,962,933 | A | 10/1999 | Henderson et al. |
| 5,990,582 | A | 11/1999 | Henderson et al. |
| 6,182,902 | B1 | 2/2001 | Shih |
| 6,188,189 | B1 | 2/2001 | Blake |

(Continued)

OTHER PUBLICATIONS

Marando et al., U.S. Appl. No. 10/459,169 entitled "Programmable PWM Stretching for Tachometer Measurement", filed on Jun. 11, 2003.

(Continued)

*Primary Examiner*—Chen Wen Jiang
(74) *Attorney, Agent, or Firm*—Meyertons Hood Kivlin Kowert & Goetzel, P.C.; Jeffrey C. Hood

(57) ABSTRACT

A fan control system in which a sensor selection block having a number of sensor inputs may be combined with an autofan block having a number of zone inputs, where the number of sensor inputs is greater than the number of zone inputs. Each one of the sensor inputs of the sensor selection block may have a corresponding sensor parameter input. The sensor selection block may be configured to map a subset of the sensor inputs with corresponding sensor parameter inputs to the autofan block. Each zone input and corresponding zone parameter input of the autofan block may receive a corresponding one of the subset of the sensor inputs with corresponding sensor parameter inputs, respectively. The autofan block may have a number of pulse width modulated (PWM) outputs that may be calculated according to the autofan block zone inputs and zone parameter inputs.

18 Claims, 3 Drawing Sheets

U.S. PATENT DOCUMENTS

| | | | |
|---|---|---|---|
| 6,208,538 | B1 | 3/2001 | Halamik et al. |
| 6,226,324 | B1 | 5/2001 | Allstrom |
| 6,247,898 | B1 | 6/2001 | Henderson et al. |
| 6,262,549 | B1 | 7/2001 | Yang et al. |
| 6,519,167 | B1 | 2/2003 | Nguyen |
| 6,528,987 | B1 | 3/2003 | Blake et al. |
| 6,563,284 | B2 | 5/2003 | Teutsch et al. |
| 6,601,168 | B1 | 7/2003 | Stancil et al. |
| 6,650,074 | B1 | 11/2003 | Vyssotski et al. |
| 6,661,679 | B1 | 12/2003 | Yang et al. |
| 2003/0193307 | A1 | 10/2003 | Burstein |
| 2004/0001542 | A1 | 1/2004 | Miller, Jr. |

OTHER PUBLICATIONS

Analog Devices, Publication ADM1027, "*dB*COOL™ Remote Thermal Controller and Voltage Monitor," 2003, 56 pages.

National Semiconductor Corporation, Publication LM63, "±1° C Accurate Remote Diode Digital Temperature Sensor with Integrated Fan Control," Feb. 2003, 28 pages.

Stephen Ohr, "Analog IC vendors find 'Intel Inside' a safe bet," Sep. 12, 2002, online at http://www.eetimes.com/story/OEG20020912S0026.

MAPPING A PLURALITY OF SENSORS TO RESPECTIVE ZONES IN A FAN CONTROL SYSTEM

BACKGROUND OF THE INVENTION

1. Field of the Invention

This invention relates to controlling rotary motors, and more particularly, to controlling the rotational speed of a fan.

2. Description of the Related Art

Fans are often used to evacuate warm air from enclosures in which electronic systems are contained. For example, most computer systems include at least one fan to aid in system cooling. The increased airflow provided by fans aids in eliminating waste heat that may otherwise build up and adversely affect system operation.

Control of fans in a system typically involves a fan control unit executing a fan control algorithm. A fan control algorithm may determine the method for controlling one or more fans that are configured to evacuate warm air from a system enclosure. For example, the fan control algorithm may specify that a fan's speed should be increased or decreased dependent upon a detected temperature. Such control algorithms may also involve turning off a fan if the temperature is deemed cool enough to do so.

Fans often include a tachometer output that provides a signal indicative of the current speed of the fan. The tachometer signal may be used to determine whether the fan is operating properly. Often, fans used for CPU and/or computer system cooling have a three-wire interface with wires for power, ground, and the tachometer signal. Fan drive systems often use a PWM (Pulse Width Modulated) signal generator to drive an external circuit that controls the voltage applied to the fan, which in turn controls the speed of the fan. PWM signal generators are useful because they provide a digital control for the pulse width of a signal. The fan is only powered for the duration of the pulse, and is typically without power between pulses. However, due to its inertia acquired while being powered, the fan will typically continue rotating even while being powered off, unless power to the fan is turned off long enough for the fan to come to a complete stop. The duty cycle of the pulse train currently being provided to the fan thus determines the fan's speed.

One problem that results from using PWM signals to drive fan circuits is that multiple cooling zones create the need for multiple sensors and multiple fans thereby causing the need for complex management schemes in fan operation management.

Many other problems and disadvantages of the prior art will become apparent to one skilled in the art after comparing such prior art with the present invention as described herein.

SUMMARY

In one embodiment, a fan control system is described which is operable to control the rotational speed of one or more fans. The fan control system may comprise a fan control block (autofan block) and a sensor selection block. A system containing an autofan block and a sensor selection block may be referred to as an extended autofan apparatus. The fan control block may be designed to support a determined number of zones, e.g., 3 zones, which may be referred to as autofan zones. In one embodiment, the fan control system comprises a number of sensors greater than the number of autofan zones, e.g., 6 sensors, where each sensor may be associated with a respective remote zone. The sensor selection block may be operable to map respective inputs from the remote zone sensors to respective autofan zones, thus allowing a greater number of sensors to be used in the system, while also allowing use of existing fan control logic such as the autofan block.

In one embodiment, the sensor selection block comprises a plurality of sensor inputs, with each sensor input having a corresponding one or more respective sensor parameter inputs. The sensor selection block may be configured to select a determined number of sensor inputs and their corresponding one or more respective sensor parameter inputs from the plurality of sensor inputs and corresponding parameter inputs, and provide corresponding sets of sensor and parameter outputs to be assigned to corresponding autofan zone inputs and autofan zone parameter inputs, respectively. In one embodiment, the sensor selection block is configured to select three sensor inputs with three corresponding sensor parameter inputs to provide to the autofan block. The autofan block may be configured to receive the three sensor outputs from the sensor selection block as respective autofan zone inputs, and the corresponding three sets of sensor parameter outputs as three corresponding autofan zone parameter inputs. The autofan block may also be configured to provide three pulse-width modulated (PWM) outputs that are calculated according to the autofan block inputs. In one embodiment, three fans may be controlled by up to six sensor inputs to the extended autofan apparatus.

The sensor inputs of the extended autofan apparatus may be temperature readings from various temperature sensors. Each sensor may have its own autofan function associated with it, for example PWM duty cycle vs. temperature, and the PWM duty cycle may be determined based on that autofan function. The sensor parameter inputs may include a minimum temperature limit, a temperature range, and/or an absolute temperature limit associated with the corresponding sensor input.

In one set of embodiments, an autofan apparatus for a system may include at least one fan in the system for maintaining a predetermined temperature in a particular region of the system. At least one PWM signal generator may be configured to provide PWM signals to the fan such that the predetermined temperature may be maintained. More than three sensors may be positioned throughout the system. The sensors may have parameters associated with them to assist in forming the PWM signals. A fan control block may also be included to calculate the PWM signal based on the sensors of the system that are mapped to zone inputs of the autofan apparatus.

The autofan apparatus may include up to six temperature sensors, each sensor providing temperature readings corresponding to a respective remote zone in the system. In other words, each sensor may be representative of a respective remote zone in the system, where each respective zone may be located in any part of the system, including on any one of the integrated circuits configured in the system. The sensors may be mapped to three autofan zone inputs for each PWM signal generated by the autofan apparatus. In some embodiments, three of the up to six temperature sensors may be mapped to three autofan zone inputs, where the three autofan zone inputs are inputs of a first autofan block. In other embodiments, three of more than three sensors configured in the system may be mapped to three autofan zone inputs of a second autofan block. In yet other embodiments, the autofan block may have more or less than three autofan zone inputs, and each autofan zone input may have a respective zone from a number of available zones greater than the number of autofan zone inputs mapped to it.

In one embodiment, a method is disclosed for an autofan block with three autofan zone inputs generating at least three PWM signal outputs in a computer system, based on sensor input received from a selection of up to three sensors selected from a set of more than three available sensors, each sensor representing a respective remote zone. The method may include mapping up to six temperature sensor inputs across the autofan block such that up to three of the temperature sensors may be assigned to three autofan zone inputs of the autofan block. The method may also include configuring the autofan block with a combination of temperature sensors mapped to the autofan zone inputs for each PWM output independently. Configuring the autofan block may include sending instructions to the autofan block to configure the autofan block for the autofan zone inputs and allowing the autofan block to generate PWM signal outputs in accordance with the instructions that are received from the fan control unit.

In one embodiment, a PWM signal generator in a computer system for generating PWM signals to be used for cooling selected zones in the computer system includes configuration registers that store information regarding the zones of the computer system. The configuration register information may be used for calculating PWM signals. The PWM signal generator may include at least three sensor inputs. There may be at least six temperature sensors in the computer system with three or less of the temperature sensors being mapped to the at least three sensor inputs for the PWM signal generator. Also, at least one fan may be disposed in the computer system. The at least one fan may be electrically coupled to the PWM signal generator such that a PWM signal may be sent to the fan according to the temperature sensor mapping. The PWM signal generator may also include a fan control unit electrically coupled to the PWM signal generator such that the PWM signals may be generated according to directions from the fan control unit.

Other aspects of the present invention will become apparent with reference to the drawings and detailed description of the drawings which follow.

BRIEF DESCRIPTION OF THE DRAWINGS

Certain but not other aspects of the invention will become apparent upon reading the following detailed description and upon reference to the accompanying drawings in which.

Figure 1:
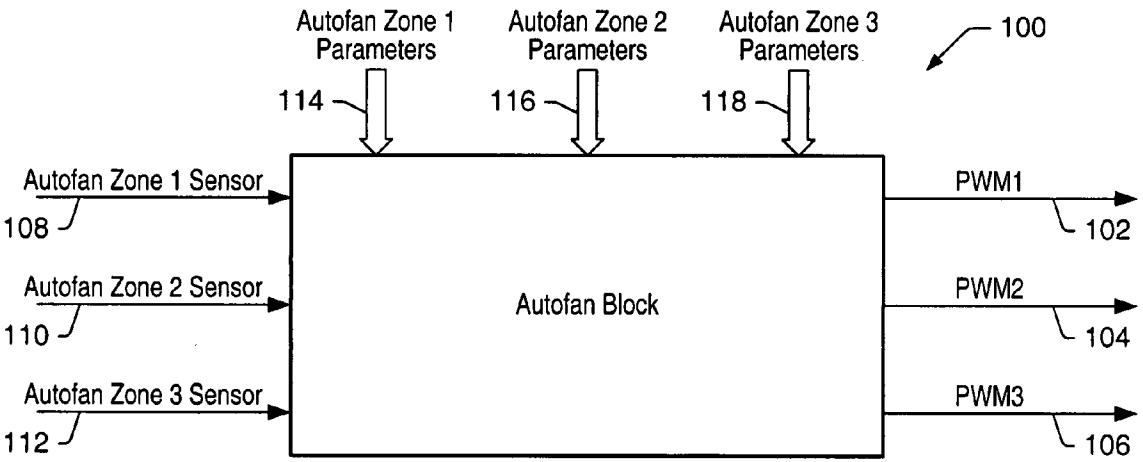
FIG. 1 illustrates a block diagram of an autofan block that may be used to generate three pulse width modulated (PWM) signals based on three autofan zone input signals in accordance with certain but not other principles of the present invention.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling with the spirit and scope of the present invention as defined by the appended claims.

DETAILED DESCRIPTION OF THE DRAWINGS

FIG. 1 illustrates a block diagram of an autofan block 100. The autofan block 100 may be used to generate three pulse width modulated (PWM) signals 102, 104, and 106 based on three sets of autofan zone input signals, where each set of autofan zone inputs may be representative of a respective select zone in a computer system in accordance with certain but not other principles of the present invention. The autofan zone input signals typically include autofan zone sensor inputs 108, 110, and 112, and their corresponding autofan zone parameter inputs 114, 116, and 118. Autofan block 100 uses an autofan algorithm with autofan zone sensor inputs 108, 110, and 112 and autofan zone parameter inputs 114, 116, and 118 to control which of autofan zone sensor inputs 108, 110, and 112 will control which of PWM signal outputs 102, 104, and 106. Autofan zone sensor inputs 108, 110, and 112 correspond with sensors that are located in various zones of a computer system, also referred to as remote zones. As used herein, the term "autofan zone" is meant to designate a zone as referenced by the autofan block, and "remote zone" is meant to designate an actual zone in the system, which may contain a respective sensor used to obtain temperature readings from the actual zone containing the respective sensor. The actual zone may be configured in any part of the system, including any integrated circuit or circuits comprised in the system, where the integrated circuit or circuits may include the autofan block.

The temperature of each of the remote zones in the computer system is monitored and controlled by the sensors in conjunction with the corresponding sensor parameter input or set of parameter inputs. As used herein, for the sake of simplicity, "sensor parameter input" is meant to refer to a single parameter, or a set of parameters. Autofan block 100 may be configured such that PWM signals 102, 104, and 106 are each generated based on a respective autofan zone sensor input 108, 110, and 112 and its corresponding autofan zone parameter input 114, 116, and 118. Alternately, each PWM signal 102, 104, and 106 may be generated after analyzing the current values received from autofan zone sensor inputs 108, 110, and 112 with corresponding autofan zone parameter inputs 114, 116, and 118, for two or more autofan zones. Specifically, and used as an example, PWM signal 102 may be generated using data received from autofan zone sensor input 110 in case a determination has been made that PWM signal 102 is to be controlled by the "hottest" of autofan zones, and based on data received from autofan zone sensor inputs 108 and 110, autofan zone sensor input 110 is found to correspond to the highest PWM duty cycle value. Alternately, by way of the above example, PWM signal 102 may be configured to be controlled by the "hottest" of all three autofan zones based on data received from autofan zone sensor inputs 108, 110, and 112. In one embodiment, when PWM signal 102 is configured for one of the "hottest" options, the autofan zone sensor input that results in the highest duty cycle would control PWM signal 102. As may be appreciated upon review of the present disclosure, other variations/combinations of sensor parameter inputs 114, 116, and 118, and zone sensor inputs 108, 110, and 112 may be possible to generate PWM signals 102, 104, and 106.

Autofan block 100 may include at least one PWM signal generator that generates a PWM signal that powers a fan. The PWM signal generator may generate the PWM signal in response to one or more control signal(s) from a fan control unit. For example, the PWM signal generator may modify the duty cycle (the ratio of the time in which the PWM signal is asserted to the time in which the PWM signal is not asserted) of the PWM signal, or cease generating the PWM signal altogether, in response to one or more control signals from the fan control unit. Modifying the duty cycle of the PWM signal modifies the speed of the fan. As the duty cycle increases, the fan may be powered for a greater percentage of time each cycle. Consequentially, the fan speed may increase. Similarly, as the duty cycle decreases, the fan speed may decrease. In one embodiment, the control signals may digitally program the pulse width of the PWM signal. The PWM signal generator may include a register or memory that stores a digital value that controls the current pulse width. The PWM signal generator may be configured to update this digital value in response to control signals from the fan control unit.

Figure 2:
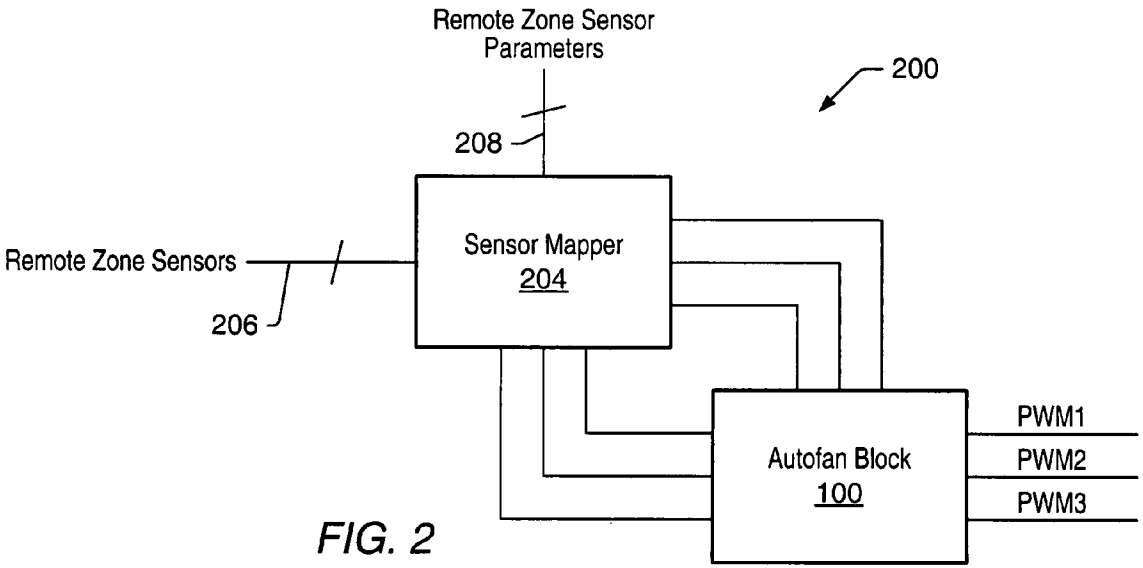
FIG. 2 is a block diagram of an exemplary autofan block operating in conjunction with a sensor mapper according to certain but not other principles of the present invention.

FIG. 2 is a block diagram of an enhanced autofan block 200 wherein autofan block 100 is operating in conjunction with a sensor mapper 204 according to certain but not other principles of the present invention. Sensor mapper 204 provides an opportunity for autofan block 100 to increase the number of sensors that can be monitored yet still use only three sets of autofan zone inputs, that is, three autofan zone sensor inputs with the three corresponding respective autofan zone parameter inputs.

In the embodiment of FIG. 2, sensor mapper 204 is illustrated with a sensor input 206 and a sensor parameter input 208. In one embodiment, inputs 206 and 208 may include up to six separate inputs each. In alternate embodiments, inputs 206 and 208 may include more than six inputs each. Sensor mapper 204 may be configured to map inputs 206 and 208 to the inputs of autofan block 100 such that autofan block 100 receives only three autofan zone sensor inputs and three autofan zone parameter inputs. In one embodiment, autofan block 100 operates as if only three inputs were being monitored, but six or more inputs may actually be monitored when sensor mapper 204 is used in conjunction with autofan block 100. Sensor mapper 204 may be configured to map a single one of the six or more sensor inputs 206 to a single respective autofan zone sensor input of autofan block 100. Similarly, sensor mapper 204 may also be configured to map a single sensor parameter input to a single respective autofan zone parameter input of autofan block 100.

Figure 3:
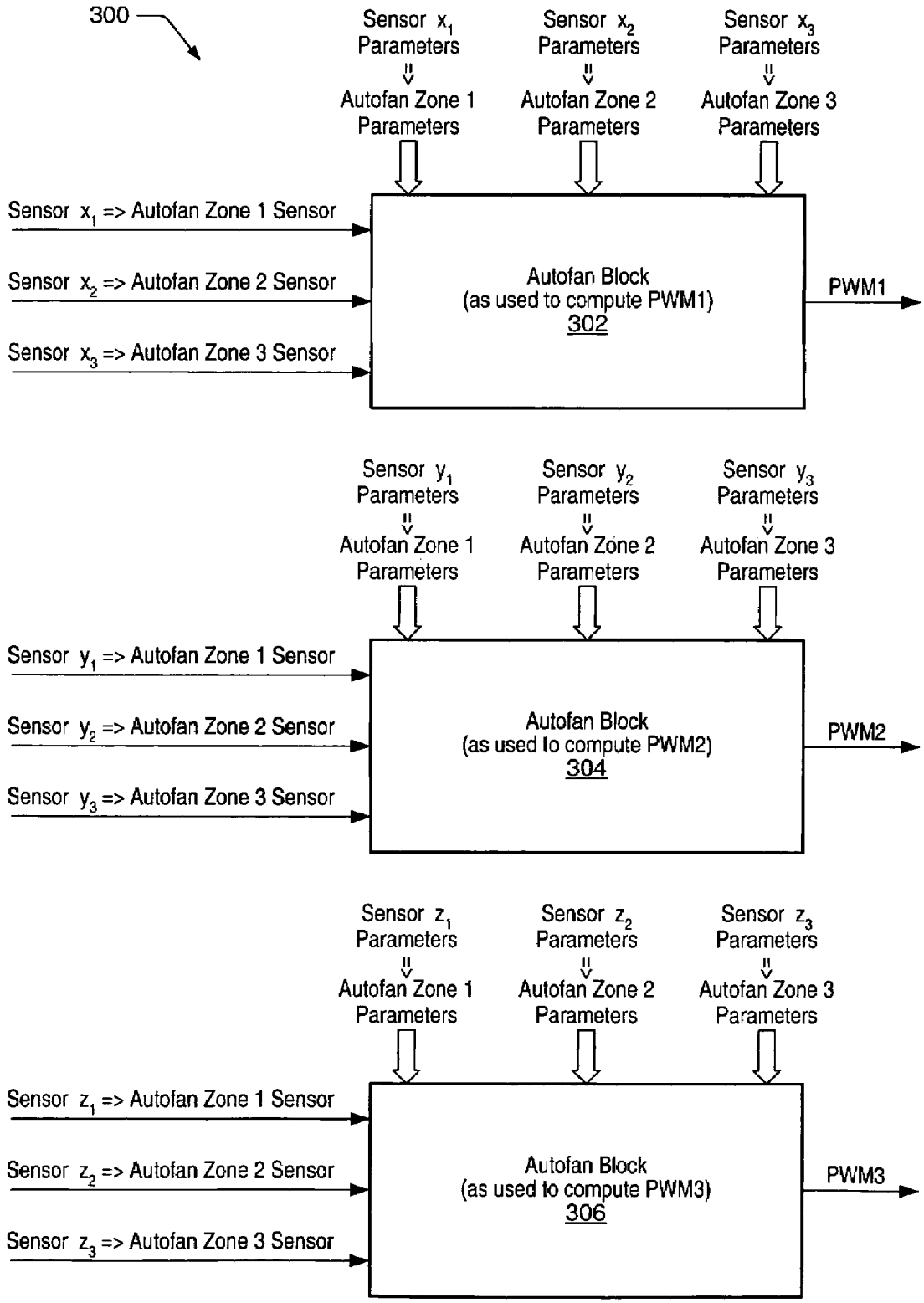
FIG. 3 illustrates a block diagram representing three individual operations of the autofan block of FIG. 1, where each individual operation comprises generating an individual PWM signal with each autofan block diagram representing a unique functionality of the autofan block of FIG. 1.

FIG. 3 illustrates a block diagram that represents functionality of three distinct autofan block operations 300, where autofan block 302 generates PWM1, autofan block 304 generates PWM2, and autofan block 306 generates PWM3, each autofan block representing separate functionality of autofan block 100. For example, autofan block 100 may receive zone sensor inputs 108, 110, and 112 from a sensor mapper such as sensor mapper 204. Although other combinations are contemplated, sensor mapper 204 may receive six sensor inputs of which three may be mapped to autofan block 302, which is used to compute a first PWM signal, three of the sensor inputs may be mapped to autofan block 304 used to compute a second PWM signal, and three of the sensor inputs may be mapped to autofan block 306 used to compute a third PWM signal.

As stated, other combinations are contemplated, e.g., three of the six sensor inputs could be mapped to each of the autofan blocks. In other words, for example, three of the six sensor inputs may be mapped to autofan block 302 such that each one of the three mapped sensor inputs is mapped to a single respective autofan zone sensor input. Similarly, three sensor parameter inputs corresponding to the three mapped sensor inputs may each be mapped to a respective autofan zone parameter input of autofan block 302. Those skilled in the art will also appreciate that such mappings may likewise be performed for autofan block 304 and autofan block 306 for any three of the six sensor inputs and corresponding sensor parameter inputs.

As illustrated in FIG. 3, autofan blocks 302, 304, and 306 may each have three autofan zone sensor inputs with corresponding autofan zone parameter inputs. These inputs may be used to compute the respective PWM signal for autofan block 302, autofan block 304, and autofan block 306. Nine different sets of inputs are shown for autofan blocks 302, 304, and 306. Illustrated are sensor inputs $x_1$, $x_2$ and $x_3$ for autofan block 302, sensor inputs $y_1$, $y_2$, and $y_3$ for autofan block 304, and sensor inputs $z_1$, $z_2$ and $Z_3$ for autofan block 306. Respective parameter inputs corresponding to each sensor input for each autofan block are also shown. As can be observed in FIG. 3, for example, sensor inputs $x_1$, $x_2$, and $x_3$ are mapped to autofan zone 1 sensor input, autofan zone 2 sensor input, and autofan zone 3 sensor input of autofan block 302, respectively, and the sensor parameters for $x_1$, $x_2$, and $x_3$ are mapped to autofan zone 1 parameter input, autofan zone 2 parameter input, and autofan zone 3 parameter input of autofan block 302, respectively. Sensor inputs $y_1$, $y_2$, and $y_3$, and sensor inputs $z_1$, $z_2$, and $z_3$ are similarly mapped to autofan zone 1 sensor input, autofan zone 2 sensor input, and autofan zone 3 sensor input of autofan blocks 304 and 306, respectively, with the corresponding sensor parameter inputs for $y_1$, $y_2$, and $y_3$, and $z_1$, $z_2$, and $z_3$ mapped to autofan zone 1 parameter input, autofan zone 2 parameter input, and autofan zone 3 parameter input of autofan blocks 304 and 306, respectively. Sensors $x_1$, $x_2$, and $X_3$ may constitute any three of the sensors available to sensor mapper 204. Similarly, $y_1$, $y_2$, and $y_3$ may constitute any three of the sensors available to sensor mapper 204, and $z_1$, $z_2$, and $z_3$ may also constitute any three of the sensors available to sensor mapper 204.

As previously stated, autofan blocks 302, 304, and 306 of FIG. 3 serve to illustrate individual autofan block operations 300 of autofan block 100, for computing three independent PWM values. Hence, autofan zone 1 sensor input, autofan zone 2 sensor input, and autofan zone 3 sensor input of autofan blocks 302, 304, and 306 may be representative of autofan zone sensor inputs 108, 110, and 112 of autofan block 100, respectively, and autofan zone 1 parameter input, autofan zone 2 parameter input, and autofan zone 3 parameter input of autofan blocks 302, 304, and 306 may be representative of autofan zone parameter inputs 114, 116, and 118 of autofan block 100, respectively. It will then be appreciated that when the functionality of autofan blocks 302, 304, and 306 is combined, autofan block 100 may be obtained as shown in FIG. 1. It will also be appreciated that the mappings of the sensor inputs as shown for individual autofan blocks 302, 304, and 306 in FIG. 3 may also be collectively applied to autofan zone sensor inputs 108, 110, and 112. Similarly, the mappings of the sensor parameter inputs as shown for individual autofan blocks 302, 304, and 306 in FIG. 3 may also be collectively applied to autofan zone parameter inputs 114, 116, and 118.

It should be noted that while sensor readings and corresponding sensor parameters from nine different sensors are shown to be mapped in FIG. 3, some or all of the nine mapped sensors might represent the same physical sensor. Furthermore, those skilled in the art will appreciate that sensor mapper 204 may be used to select from any number of sensors to map the sensor inputs to autofan zone sensor inputs 108, 110, and 112, and to map the corresponding sensor parameter inputs to autofan zone parameter inputs 114, 116, and 118. In one embodiment, three sensors are mapped by sensor mapper 204 from an available six sensors to three autofan zone sensor inputs. In alternate embodiments, autofan block 100 may have more than three autofan zone sensor inputs, and sensor mapper 204 may have more than six available sensors from which to map to the more than three autofan zone sensor inputs.

Figure 4:
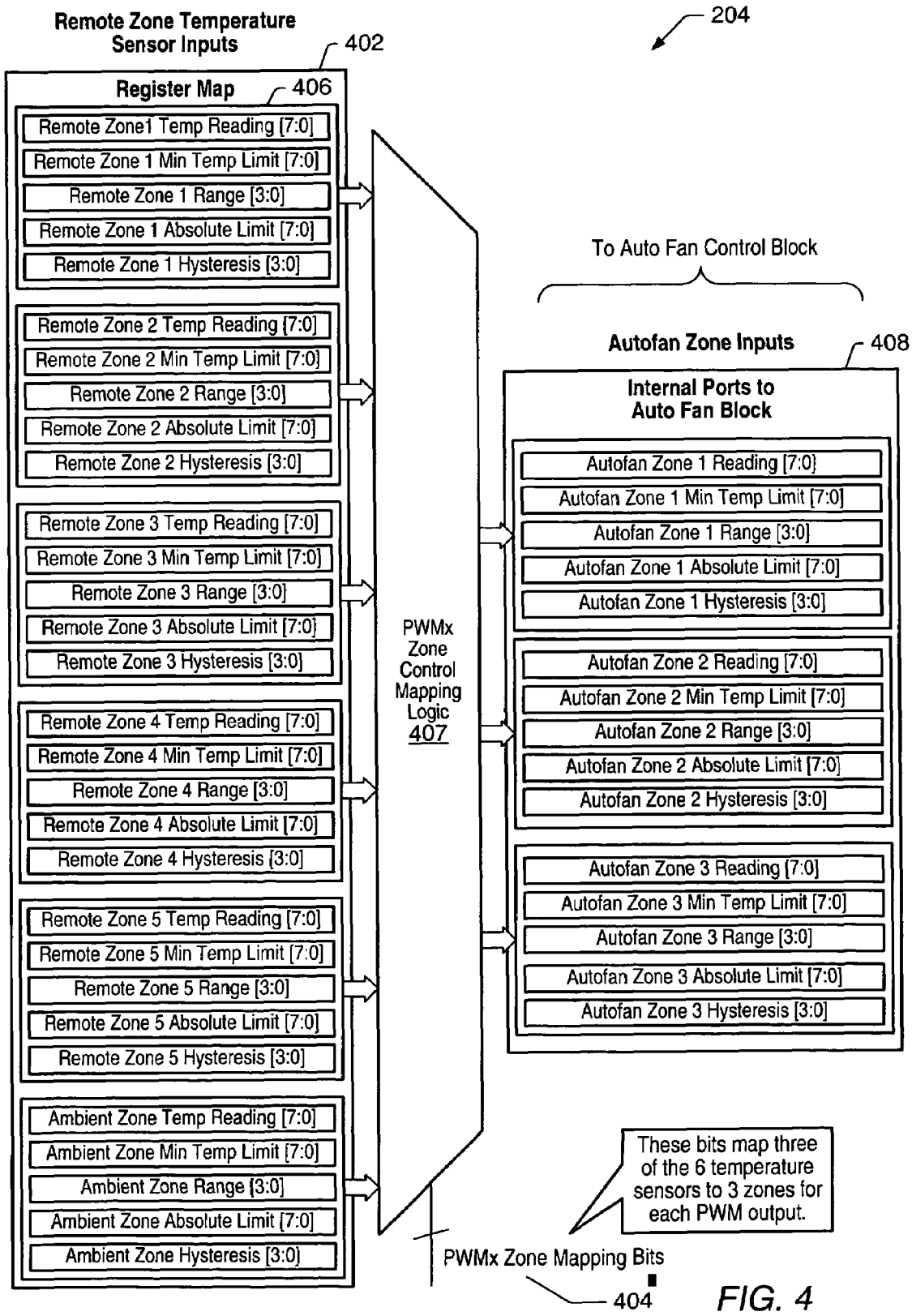
FIG. 4 illustrates one embodiment of the mapping of sensor inputs and corresponding sensor parameters to an autofan block such as the autofan block of FIG. 2.

FIG. 4 illustrates one embodiment of the mapping of remote zone temperature sensor readings and parameters to an autofan block such as autofan block 100 included in enhanced autofan block 200. Sensor mapper 204 is illustrated in more detail. In one embodiment, sensor mapper 204 includes zone control mapping logic 407 and internal output ports 408. Sensor mapper 204 may receive, as inputs, data from a register map 402 where input data corresponding to each respective one of six remote zone temperature sensors may be stored. It should be noted that while FIG. 4 shows register map 402 as being separate from sensor mapper 204, in alternate embodiments, register map 402 may be configured inside sensor mapper 204. In yet other embodiments, register map 402 may be implemented as part of a register block that is part of a system, where data from register map 402 may be routed to inputs of sensor mapper 204.

Register map 402 may include a register bank, such as registers 406, corresponding to each of the six remote zone temperature sensors for storing temperature reading values and parameter values associated with a respective remote zone. Registers 406 may include a reading register for holding temperature readings for the respective remote zone, a remote zone minimum temperature limit register, a remote zone temperature range register, a remote zone absolute limit register, and a remote zone hysteresis register. Zone control mapping logic 407 configured in sensor mapper 204 may determine which of the register banks map to internal ports 408 of autofan block 100 configured in enhanced autofan block 200. In other words, zone control mapping logic 407 may be responsible for associating selected register banks with corresponding autofan zone inputs of autofan block 100 configured in enhanced autofan block 200. Data from the mapped register banks are therefore used as the autofan zone sensor and autofan zone parameter inputs for autofan 100. In one embodiment, temperature readings for the respective remote zone comprise the sensor input and may be mapped to a respective autofan zone sensor input, and the values held by the remaining registers comprise the sensor parameter inputs, which may be mapped to a respective autofan zone parameter input. Autofan 100 may then operate as if inputs from only three remote zones were controlling autofan 100.

Each of the remote zone sensor inputs may represent one or more zones that are each monitored separately to produce appropriate PWM signals for a system in accordance with certain but not other principles of the present invention. Fans in each of the cooling zones may be controlled by a fan control unit. Although more zones are contemplated, for purposes of understanding principles according to the present invention, in the illustrated embodiment the system is a computer system that includes three cooling zones. Each cooling zone may include a fan, which may be used to evacuate warm air from an enclosure in which the computer system may be contained.

In one embodiment, zone mapping bits 404 may be used by zone control mapping logic to select which remote zone input data will be mapped to autofan zone sensor inputs 108, 110, and 112, and autofan zone parameter inputs 114, 116, and 118. A finite state machine may be used to determine and/or change the values of zone mapping bits 404 to control mapping of the remote zone inputs to autofan block 100. It should be noted that other embodiments may prefer other methods to determine/change the values of zone mapping bits 404, and those skilled in the art will appreciate the many alternative methods that are available to perform such control. As also noted, while FIG. 4 illustrates register data for six different remote zones, alternate embodiments may preferably use registers to hold sensor input and sensor parameter data for less than six remote zones or more than six remote zones, which may then be mapped to more than three or less than three sets of respective autofan zone inputs, the number of available remote zones exceeding the number of autofan zone inputs in each case.

Numerous variations and modifications will become apparent to those skilled in the art once the above disclosure is fully appreciated. It is intended that the following claims be interpreted to embrace all such variations and modifications.

What is claimed is:

1. A fan control system comprising:

a sensor selection block having a first number of sensor inputs, each one of the first number of sensor inputs having a corresponding sensor parameter input, wherein the sensor selection block is operable to produce a second number of zone outputs with a corresponding second number of zone parameter outputs based on the first number of sensor inputs and corresponding first number of sensor parameter inputs; and an autofan block operable to receive the second number of zone outputs with the corresponding second number of zone parameter outputs as corresponding second number of zone inputs with corresponding second number of zone parameter inputs;

wherein the autofan block is further operable to generate one or more pulse width modulated (PWM) outputs that are calculated according to the second number of zone inputs and the second number of zone parameter inputs; and wherein the first number is greater than the second number.

2. The fan control system of claim 1, wherein the autofan block is configured with a second number of pulse width modulated (PWM) outputs;

wherein each respective one of the second number of zone inputs corresponds to a respective one of the second number of PWM outputs;

wherein each respective PWM output is calculated according to its corresponding respective zone input.

3. The fan control system of claim 1, wherein each one of the one or more PWM outputs is configured to control respective one or more fans.

4. The fan control system of claim 1, wherein the sensor inputs comprise temperature readings from various temperature sensors.

5. The fan control system of claim 1, wherein each sensor parameter input is configured to aid in specifying a PWM signal duty cycle value corresponding to the sensor parameter input's respective corresponding sensor input.

6. The fan control system of claim 1, wherein the sensor selection block is operable to select the second number of zone outputs according to a selection control scheme configured in the fan control system.

7. The fan control system of claim 1, wherein each one of the first number of sensor inputs corresponds to at least one respective temperature zone in a computer system.

8. A system comprising:

a plurality of fans disposed in the system for maintaining a predetermined temperature in corresponding zones of the system;

one or more pulse width modulated (PWM) signal generators, each PWM signal generator configured to provide a corresponding PWM signal to respective one or more fans of the plurality of fans such that the predetermined temperature in one or more zones corresponding to the respective one or more fans is substantially maintained;

a number of sensors positioned throughout the system, each sensor having parameters associated therewith to assist in forming PWM signals;

a fan control block having a number of sensor inputs, each sensor input having a respective sensor mapped to it;

wherein the fan control block is operable to calculate a duty cycle value for each corresponding PWM signal based on input data received from the sensors; and wherein the number of sensors is greater than the number of sensor inputs.

9. The system of claim 8, wherein each sensor is configured to monitor a respective zone of the system.

10. The system of claim 8, wherein the fan control block is configured to have a respective set of sensors mapped to the sensor inputs for each corresponding PWM signal.

11. The system of claim 10, wherein in having the respective set of sensors mapped to the sensor inputs, the mapping is determined by a finite state machine configured in the fan control block.

12. A method for generating PWM signals in a system using a fan controller having a number of zone inputs, the method comprising:

mapping a subset of a number of sensor inputs across the fan controller, wherein said mapping the subset of the number of sensor inputs comprises assigning each zone input at least one sensor input of the subset of the number of sensor inputs; and generating a PWM signal in accordance with data received from the subset of the number of sensor inputs mapped across the fan controller;

wherein the number of zone inputs is less than the number of sensor inputs.

13. The method of claim 12 further comprising:

generating two or more additional PWM signals; and for each respective one of the two or more additional PWM signals:

mapping a corresponding subset of the number of sensor inputs across the fan controller, wherein said mapping the corresponding subset of the number of sensor inputs comprises assigning each zone input at least one sensor input of the corresponding subset of the number of sensor inputs; and generating the respective one of the two or more additional PWM signals in accordance with data received from the corresponding subset of the number of sensor inputs.

14. The method of claim 12, wherein said assigning each zone input at least one sensor input of the subset of the number of sensor inputs comprises:

assigning each zone input at least one sensor input of the subset of the number of sensor inputs based on a control scheme configured in the fan controller.

15. The method of claim 14, wherein the control scheme is implemented in a finite state machine.

16. A PWM signal generator in a computer system for generating PWM signals to be used for cooling zones of the computer system comprising:

configuration registers configured to store information regarding the zones of the computer system, the configuration register information being used for calculating PWM signals;

at least three sensor inputs for the PWM signal generator;

at least six temperature sensors in the computer system, three or less of the at least six temperature sensors being mapped to the at least three sensor inputs for the PWM signal generator; and at least one fan disposed in the computer system, the at least one fan being electrically coupled to the PWM signal generator such that a PWM signal may be sent to the fan according to the at least six temperature sensor mapping.

17. The PWM signal generator of claim 16 further comprising a fan control unit electrically coupled to the PWM signal generator such that the PWM signals may be generated according to directions from the fan control unit.

18. An autofan block for controlling one or more fans disposed in a system, a plurality of PWM signal generators also disposed in the system, each respective one of the one or more fans operable to maintain a predetermined temperature in a corresponding zone of the system, each respective one of the one or more fans being powered by a respective PWM signal provided by a corresponding one of the plurality of PWM signal generators such that the predetermined temperature is substantially maintained in each corresponding zone of the system, and a number of sensors positioned throughout the system with each sensor having parameters associated therewith to assist in forming PWM signals, the autofan block comprising:

a number of sensor inputs, each sensor input having a respective sensor mapped to it;

wherein the autofan block is operable to calculate a duty cycle value for each one of the plurality of PWM signal generators based on input data received from the sensors; and wherein the number of sensors is greater than the number of sensor inputs.

* * * * *